US007070741B2

(12) United States Patent
Ikenoue et al.

(10) Patent No.: US 7,070,741 B2
(45) Date of Patent: Jul. 4, 2006

(54) HOLDER FOR FREEZE-DRYING OF DRUG SOLUTIONS

(75) Inventors: Masaki Ikenoue, Osaka (JP); Masanobu Iwasa, Osaka (JP)

(73) Assignee: Nipro Corporation, Osaka (JP)

( * ) Notice: Subject to any disclaimer, the term of this patent is extended or adjusted under 35 U.S.C. 154(b) by 467 days.

(21) Appl. No.: 10/273,121

(22) Filed: Oct. 18, 2002

(65) Prior Publication Data

US 2003/0077208 A1 Apr. 24, 2003

(30) Foreign Application Priority Data

Oct. 19, 2001 (JP) ..... 2001-321312

(51) Int. Cl.
*B01L 9/00* (2006.01)

(52) U.S. Cl. ..... 422/104; 206/96; 206/139; 422/99; 422/102; 422/58

(58) Field of Classification Search ..... 422/99, 422/58, 102, 104, 100; 206/96, 139
See application file for complete search history.

(56) References Cited

U.S. PATENT DOCUMENTS 4,035,924 A 7/1977 Faure
4,609,102 A 9/1986 Blum
6,199,297 B1 3/2001 Wisniewski

FOREIGN PATENT DOCUMENTS

JP 10-305083 A 11/1998
JP 10305083 * 11/1998

OTHER PUBLICATIONS

Patent Abstracts of Japan, Publ. No. 10-305-83, Nov. 17, 1998, "Freeze Drying Method for Medicine Solution," Yasuhiro Matsuoka.
Patent Abstracts of Japan, Publ. No. 11-178893, Jul. 6, 1999, "Freeze-Drying of Medicine," Yasuhiro Matsuoka.

* cited by examiner

*Primary Examiner*—Jill Warden
*Assistant Examiner*—Jyoti Nagpaul
(74) *Attorney, Agent, or Firm*—Birch, Stewart, Kolasch & Birch, LLP

(57) ABSTRACT

A holder comprises a base 1 having an inclined plane 11 increased in height from a distal end thereof to the proximal end thereof; air releasing means 2 provided on the proximal end of the base 1; and closing means 3 for closing an opening B1 of a flexible container set on the base 1. The closing means 3 comprises a pressure assembly 31 having closing bars 311, 312 extending in the direction perpendicular to the longitudinal axis X of the base 1,and a lever 32. The pressure assembly 31 is adapted to doubly seal the opening B1 of the flexible container B when the lever 32 is turned over toward the distal end of the base 1.

20 Claims, 4 Drawing Sheets

HOLDER FOR FREEZE-DRYING OF DRUG SOLUTIONS

BACKGROUND OF THE INVENTION

The present invention relates to a holder for freeze-drying of drug solutions. More particularly, the present invention relates to a holder for freeze-drying of drug solutions, which makes it possible to efficiently and precisely charge a predetermined amount of a drug solution into a container without any fear of contamination of drugs with foreign substances.

Lyophilization or Freeze-drying is a well-known method for drying drugs at low temperatures and at vacuum pressures, which makes it possible to produce drugs with very high solubility, without decreasing activities of the unstable drugs. Conventionally known methods for production of freeze-dried drugs include the following two methods:

I) A method comprising the steps of charging a drug solution into a container such as a glass vial, freeze drying the drug solution in a vacuum drying chamber, introducing aseptically filtered dry inert gas into the drying chamber, and then sealing the container with a plug; and II) A method comprising the steps of freeze-drying a lot of drugs in a container such as a tray (commonly referred to as "tray drying"), pulverizing the resultant freeze-dried drugs, sieving the resultant powder to separate particles of a uniform size, and then charging the powder into the containers with a powder charger.

However, these conventional methods have advantages and problems to be solved. For this reason, one of the present inventors and other inventors proposed in an unexamined Japanese patent publication No. JP-A-H10-305083, a method for freeze drying of drugs, employing a flexible container or bag as a container for freeze-drying and also as a packaging container for freeze-dried drugs as it is. JP-A-H10-305083 also discloses a holder for freeze-drying of drugs (cf., FIG. 6), in which a pressure assembly 31 includes a bar 311 for closing an opening of the flexible container. In this method, the container or bag is closed by the bar 311 after freeze-drying, taken out of a freeze-drying chamber, and then sealed at an opening thereof by hot welding.

However, when sealing the opening of the flexible container by hot welding, there remains space, which may allow foreign substances or bacteria to invade into the interior of the container, between a sealing part of the container and the bar or within a freeze-dried drug-holding area inside the sealing portion. It has become apparent that the above problem results from the fact that the above holder has only one pressure bar.

SUMMARY OF THE INVENTION

The present invention has been made in view of the above circumstances to provide a holder for freeze-drying of drug solutions, which makes it possible to prevent foreign substances or bacteria from contaminating the inside of the flexible container over the sealing part thereof when sealing the opening of the container by hot welding.

The present invention has been made on the findings that empty space of a container can be closed by providing a holder with two pressure closing bars.

According to the present invention, there is provided a holder for freeze-drying of drug solutions comprising:

a base with an inclined plane increased in height from a distal end thereof to a proximal end thereof at a predetermined oblique angle $\alpha$;

air releasing means provided on the proximal end of the base to secure an air passage in an opening of a flexible container set on the base; and closing means mounted on the proximal side of the base to close the opening of the flexible container;

said closing means comprising a pressure assembly pivotally mounted on side walls of the base near the proximal end thereof and having anterior and posterior closing bars extending in the direction perpendicular to the longitudinal axis of the base, and a lever pivotally mounted on side walls of the base near the distal side thereof, said lever being connected to the anterior bar of the pressure assembly and adapted to allow the pressure assembly to doubly close the opening of the flexible container when the lever is turned toward the distal end of the base.

The inclined plane may be tapered or recessed and, preferably, has an oblique angle $\alpha$ within the range of 5 to 10 degrees. The pressure assembly may be urged by a spring toward the bottom of the base. Further, the base may be provided at a distal side thereof with a cover to hold a flexible container.

The present invention will be explained below, making reference to the accompanying drawings, which show, by way of example only embodiments thereof.

DETAILED DESCRIPTION OF THE PREFERRED EMBODIMENTS

Figure 1:
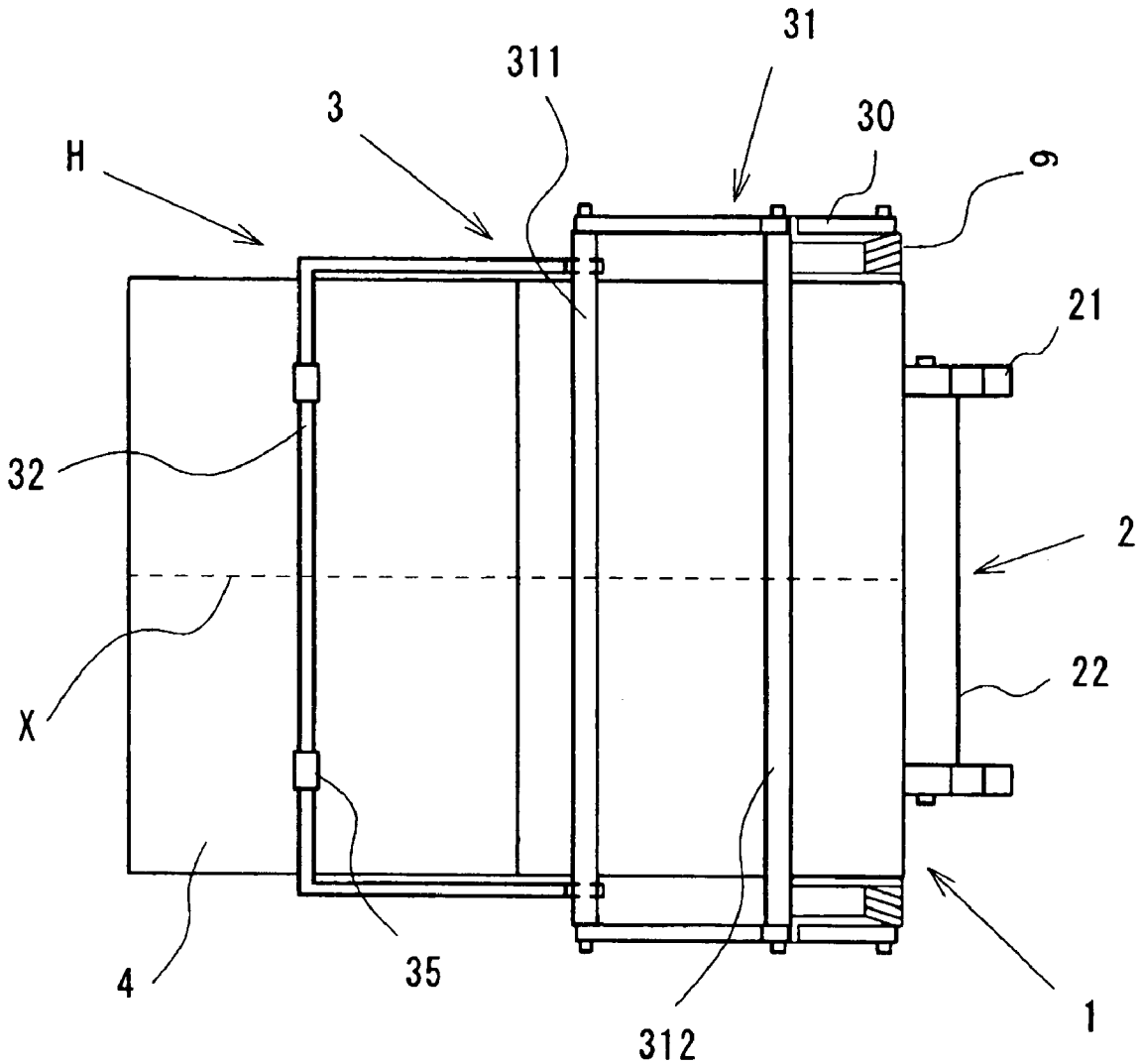
FIG. 1 is a plane view illustrating one embodiment of a holder for freeze-drying of drug solutions according to the present invention.
Figure 2:
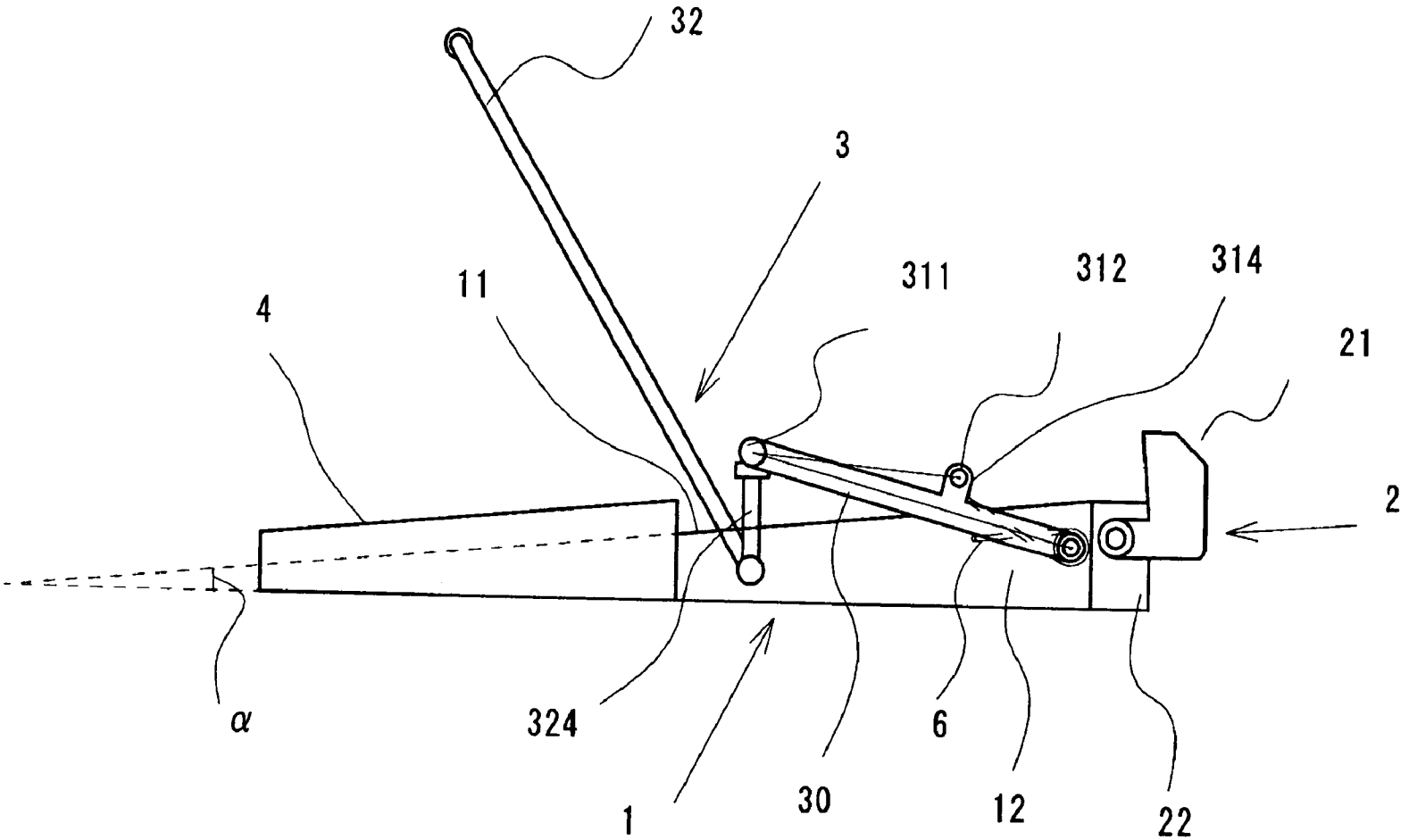
FIG. 2 is a side view illustrating the holder of FIG. 1.

Referring now to FIGS. 1 and 2, there is shown a holder for freeze-drying of drug solutions according to the present invention (hereinafter, referred to as a "holder"). The holder comprises a base 1 having an inclined plane 11 increased in height from a distal end thereof to a proximal end thereof; air releasing means 2 provided on the proximal end of the base 1; and closing means 3 for closing an opening (indicated by B1 in FIG. 3) of a flexible container (indicated by B in FIG. 3) set on the base 1.

Figure 3:
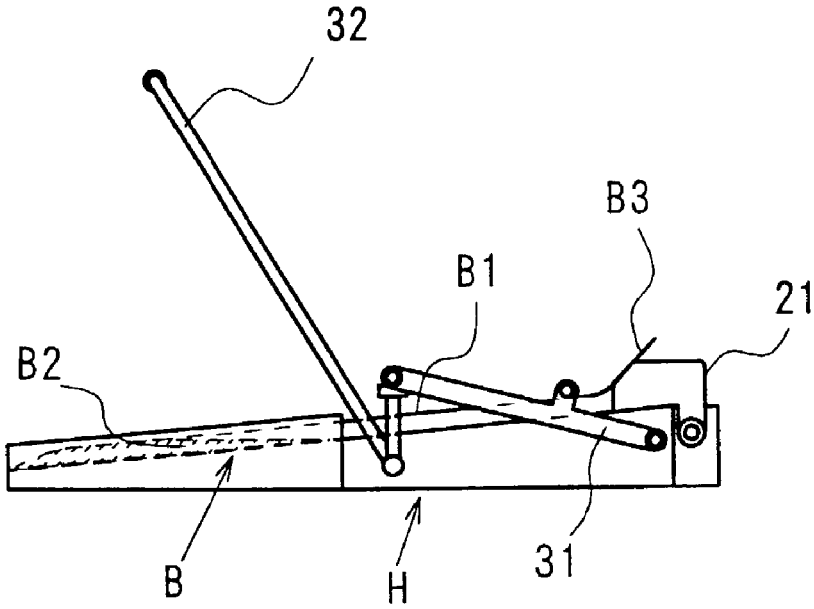
FIGS. 3 to 5 are schematic diagrams illustrating a freeze-drying process using a holder for freeze-drying of drug solutions according to the present invention.

The closing means 3 comprises a pressure assembly 31 and a lever 32. The pressure assembly 31 includes closing bars 311, 312 extending in the direction perpendicular to the longitudinal axis X of the base 1. The closing means 3 is adapted to doubly seal the opening B1 of the flexible container B set on the proximal side of the holder when the lever 32 is turned over toward the distal end of the base 1. The flexible container B is set on the holder H as illustrated in FIG. 3, so that a portion B2 containing a drug solution is put on the distal side of the base 1 and the opening B1 (a portion present on the side of open end B3 that includes a portion near the portion B2 containing a drug solution) is put on the proximal side of the base 1.

The base 1 has an inclined plane 11 increased in height from the distal end thereof to the proximal end thereof at an oblique angle $\alpha$. The base 1 is provided on its side walls 12 near the proximal end thereof with the pressure assembly 31 and near the distal side thereof with the lever 32 of the closing means 3.

The base 1 is further provided at the proximal end thereof with air releasing means 2 to secure an air passage in the opening B1 of the flexible container B which is set on the holder H (or placed on the base 1). As illustrated in the drawings, the air releasing means 2 may be comprised of, for example, mounting member 22 fixed to the base 1, and an L-shaped hook member 21 pivotally mounted on the mounting member 22. The base 1 may be provided on the distal side thereof with a cover 4 for holding the flexible container B, if necessary.

The oblique angle α of the base 1 is so determined that a drug solution in the flexible container B does not reach to the opening B1 when the flexible container B is set on the holder H. The oblique angle α is determined by a size of the flexible container B and an amount of the drug solution to be freeze-dried, generally, within the range of from 3 to 10 degrees, preferably 5 to 10 degrees. The oblique angle α of 5 to 10 degrees makes a drug solution in the container B thin and keeps the solution's edge sufficiently away from the open end B3. This makes it possible to perform freeze-drying in less time as well as to easy to perform closing and hot welding of the opening B1.

The closing means 3 comprising the pressure assembly 31 and the lever 32 is provided on the proximal side of the base 1 to protect the freeze-dried drug contained in the container B from being invaded by microbe, foreign substances and air after freeze-drying. That is, the closing means 3 is adapted to doubly close the opening B1 of the flexible container B by means of the anterior and posterior closing bars 311 and 312 to exclude any external air when the lever 32 is turned over toward the distal end of the base 1.

To this end, the pressure assembly 31 is pivotally mounted on the opposed side walls 12 of the base 1 near the proximal end thereof, and includes a frame 30 and two closing bars 311, 312 extending in the direction that intersects at right angles to the longitudinal axis of the base 1. The closing assembly 31 may be urged toward the inclined plane 11 of the base 1 by means of spring 6.

Taking a concrete example, the pressure assembly 31 may comprise a frame 30 composed of a pair of arms, each of which is pivotally mounted at one end thereof on the opposed side walls 12 of the base 1 near the proximal end thereof, and provided at the other end thereof with the first or anterior closing bar 311, as illustrated in the drawings. Each of the arms is provided at the middle portion thereof with a projection or support 314, on which the second or posterior closing bar 312 is rotatably mounted. The supports 314 are so designed that an angle between a line connecting the pivot of the arm and the pivot of the anterior closing bar 311 and line connecting the pivot of the anterior closing bar 311 and the pivot of the posterior closing bar 312 is the same as oblique angle of the base 1.

The lever 32 is pivotally mounted on the distal sides of the side walls 12 of the base 1 near the drug-containing portion B2 of the container set on the base 1, and adapted to allow the pressure assembly 31 to doubly close the opening B1 of the flexible container B by means of the anterior and posterior closing bars 311 and 312 when the lever is turned over toward the distal end of the base 1.

The lever 32 may be provided at the pivotal portions thereof with posts 324 for supporting the anterior bar 311 and on the free end side with rollers 35.

Figure 4:
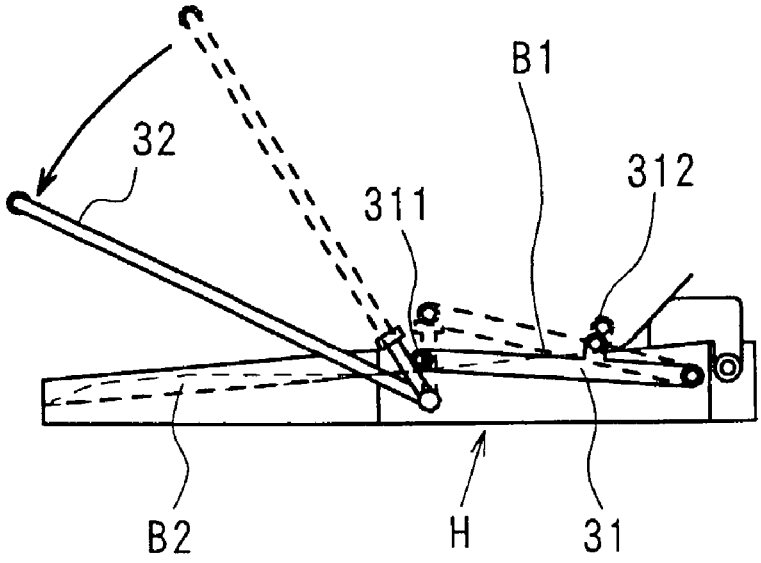
Figure 5:
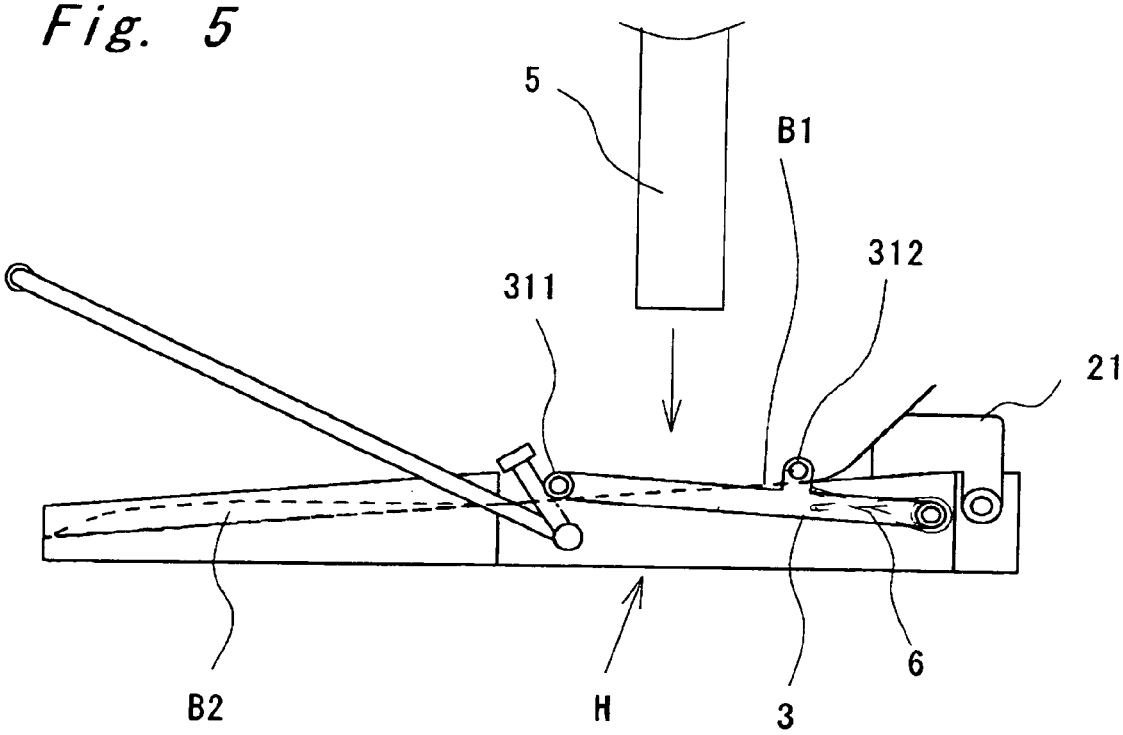
Figure 6:
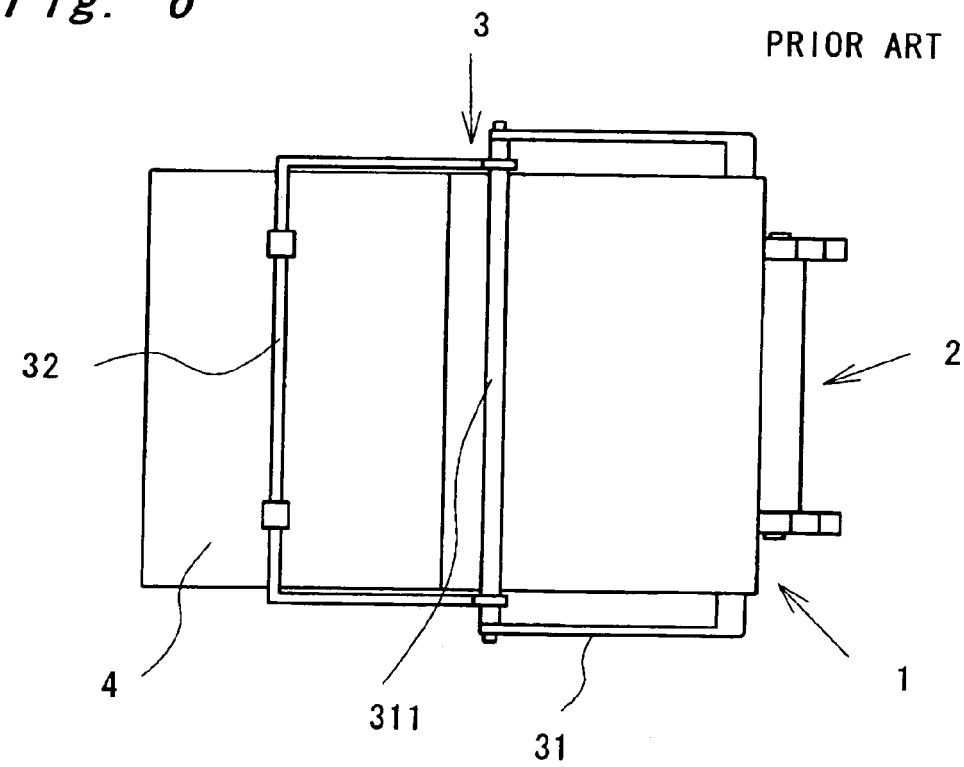
FIG. 6 is a plane view illustrating a freeze-drying holder of the prior art.

Using the holder H of the present invention, the freeze-drying of drug solutions may be carried out in the manner explained below with reference to FIGS. 3 to 5.

Firstly, there is prepared a flexible container B containing a drug solution charged therein. The flexible container B is then set on the holder H in such a manner that the solution-containing portion B2 of the container B is positioned on the distal side the base and the opening B1 of the container 1 is positioned on the proximal side of the base 1, as illustrated in FIG. 3. Then, the open end B3 of the container B is opened by the air releasing means 2. Under such a condition, the drug solution in the container B is freeze-dried in the conventional manner. After freeze-drying, the lever 32 of the closing means 3 is turned forward (i.e., toward the distal side of the base 1), whereby the pressure assembly 31 is released from the posts 324 and forced to move toward the inclined plane 11 of the base 1. Thus, the two closing bars 311, 312 of the pressure assembly 31 close the opening B1 of the flexible container B doubly at anterior and rear parts thereof. Under such a condition, the opening B1 is sealed at an empty area between two closing bars 311 and 312 by hot welding with a seal bar 5, as shown in FIG. 5. In this case, the portion B2 containing a freeze-dried drug is prevented from being contaminated with foreign substances or bacteria during hot welding of the opening Bi after freeze-drying.

As will be understood from the above description, the use of the holder for freeze-drying of drug solutions of the present invention makes it possible to completely prevent a portion inside a closed portion in a flexible container from being contaminated with foreign substances or bacteria at the time of hot welding of the opening of the container.

What is claimed is:

1. A holder for freeze-drying of drug solutions comprising:

a base with an inclined plane increased in height from a distal end thereof to a proximal end thereof at a predetermined oblique angle α;

air releasing means provided on the proximal end of the base to secure an air passage in an opening of a flexible container set on the base; and closing means mounted on the proximal side of the base to close the opening of the flexible container;

said closing means comprising a pressure assembly pivotally mounted on side walls of the base near the proximal end thereof and having anterior and posterior closing bars extending in the direction perpendicular to the longitudinal axis of the base, ends of the closing bars being retained in a frame, and a lever pivotally mounted on side walls of the base near the distal side thereof, said lever being disposed adjacent to the anterior bar of the pressure assembly and adapted to allow the pressure assembly to doubly close the opening of the flexible container when the lever is turned toward the distal end of the base.

2. The holder for freeze-drying of drug solutions according to claim 1, wherein the inclined plane is tapered or recessed.

3. The holder for freeze-drying of drug solutions according to claim 2, wherein the pressure assembly is urged by a spring toward the bottom of the base.

4. The holder for freeze-drying of drug solutions according to claim 3, further including a cover for holding a flexible container on the distal side of the base.

5. The holder for freeze-drying of drug solutions according to claim 1, wherein the oblique angle α is in the range of 5 to 10 degrees.

6. The holder for freeze-drying of drug solutions according to claim 5, wherein the pressure assembly is urged by a spring toward the bottom of the base.

7. The holder for freeze-drying of drug solutions according to claim 6, further including a cover for holding a flexible container on the distal side of the base.

8. The holder for freeze-drying of drug solutions according to claim 1, wherein the pressure assembly is urged by a spring toward the bottom of the base.

9. The holder for freeze-drying of drug solutions according to claim 8, further including a cover for holding a flexible container on the distal side of the base.

10. The holder for freeze-drying of drug solutions according to claim 1, wherein said frame comprises an arm extending along each of the side walls of the assembly, wherein the anterior and the posterior closing bars are attached to each of the arms.

11. The holder for freeze-drying of drug solutions according to claim 1, wherein the lever includes posts for supporting the anterior bar when the closing means is an open position.

12. A holder for freeze-drying of drug solutions comprising:

a base with an inclined plane increased in height from a distal end thereof to a proximal end thereof at a predetermined oblique angle $\alpha$;

air releasing means provided on the proximal end of the base to secure an air passage in an opening of a flexible container set on the base; and closing means mounted on the proximal side of the base to close the opening of the flexible container;

said closing means comprising a pressure assembly pivotally mounted on side walls of the base near the proximal end thereof and having anterior and posterior closing bars extending in the direction perpendicular to the side walls and the longitudinal axis of the base, ends of the closing bars being retained in a frame, and a lever pivotally mounted on side walls of the base near the distal side thereof, said lever being disposed adjacent to the anterior bar of the pressure assembly and adapted to allow the pressure assembly to doubly close the opening of the flexible container when the lever is turned toward the distal end of the base.

13. The holder for freeze-drying of drug solutions according to claim 12, wherein the inclined plane is tapered or recessed.

14. The holder for freeze-drying of drug solutions according to claim 13, wherein the pressure assembly is urged by a spring toward the bottom of the base.

15. The holder for freeze-drying of drug solutions according to claim 12, wherein the oblique angle $\alpha$ is in the range of 5 to 10 degrees.

16. The holder for freeze-drying of drug solutions according to claim 12, wherein the pressure assembly is urged by a spring toward the bottom of the base.

17. The holder for freeze-drying of drug solutions according to claim 16, further including a cover for holding a flexible container on the distal side of the base.

18. The holder for freeze-drying of drug solutions according to claim 12, further including a cover for holding a flexible container on the distal side of the base.

19. The holder for freeze-drying of drug solutions according to claim 12, wherein said frame comprises an arm extending along each of the side walls of the assembly, wherein the anterior and the posterior closing bars are attached to each of the arms.

20. The holder for freeze-drying of drug solutions according to claim 12, wherein the lever includes posts for supporting the anterior bar when the closing means is an open position.

* * * * *